US005348181A

United States Patent [19]

Smith et al.

[11] Patent Number: 5,348,181

[45] Date of Patent: Sep. 20, 1994

[54] WINGED CUP LID

[75] Inventors: Bruce R. Smith, Fairfield, Conn.; Reinhold Gerber, Easton, Pa.

[73] Assignee: James River Corporation of Virginia, Richmond, Va.

[21] Appl. No.: 998,589

[22] Filed: Dec. 30, 1992

[51] Int. Cl.[5] ..... B65D 51/18

[52] U.S. Cl. ..... 220/254; 220/306; 220/324; 220/326; 220/711

[58] Field of Search ..... 220/306, 315, 326, 711, 220/712, 713, 254, 262

[56] References Cited

U.S. PATENT DOCUMENTS

| | | | |
|---|---|---|---|
| 3,421,681 | 1/1969 | Frank | 220/712 X |
| 3,589,551 | 6/1971 | Haggbom | 220/326 X |
| 3,688,942 | 9/1972 | Mitchell et al. . | |
| 4,049,187 | 9/1977 | Florian . | |
| 4,090,660 | 5/1978 | Schram et al. | 220/306 X |
| 4,284,200 | 8/1981 | Bush et al. | 220/315 X |
| 4,314,651 | 2/1982 | Gaiser et al. | 220/326 |
| 4,351,447 | 9/1982 | Graff . | |
| 4,376,493 | 3/1983 | Gall | 220/307 |
| 4,394,928 | 7/1983 | Philip | 220/713 X |
| 4,465,205 | 8/1984 | Sutch . | |
| 4,629,088 | 12/1988 | Durgin . | |
| 4,721,210 | 1/1988 | Lawrence et al. | 220/306 X |
| 5,111,961 | 5/1992 | Van Melle | 220/712 |
| 5,147,059 | 9/1992 | Olsen et al. | 220/306 X |
| 5,203,467 | 4/1993 | Tucker | 220/254 |

*Primary Examiner*—Allan N. Shoap
*Assistant Examiner*—Stephen Cronin
*Attorney, Agent, or Firm*—Sixbey, Friedman, Leedom & Ferguson

[57] ABSTRACT

The drinking cup lid includes a cover portion and at least one tab extending from the cover portion and movable into a retaining position adjacent the sidewalls of the cup to securely attach the lid to the cup while providing a gripping area insulated from the thermal effects of the contents of the cup. The tabs include a retaining groove adapted to receive the rim of the cup and a latching lip for sealingly engaging the rim when the tabs are moved into the retaining position. A gripping portion of each tab is positioned adjacent the sidewalls when the tabs are in the retaining position. The gripping portion is maintained a spaced radial distance from the sidewalls by both a hinge which provides a pivot axis about which the tab rotates and a rib formed by a stiffening groove extending along the tab.

23 Claims, 3 Drawing Sheets

WINGED CUP LID

TECHNICAL FIELD

The present invention relates to an improved lid or drinking cups which may be securely attached to a cup rim while thermally insulating the user's fingers from the contents of the cup.

BACKGROUND OF THE INVENTION

Drinking cup lids adapted to fasten over the rim or lip of drinking cups are well known. Such lids prevent spillage and evaporation of the beverage within the cup, and help insulate the contents of the cup from the ambient temperature by closing the cup opening. In their most simple form, such cup lids comprise a generally fiat lid surface in the form disk having a peripheral sealing skirt for securing the lid to the rim of the cup.

As shown in U.S. Pat. No. 4,629,088 issued to Durgin, improved lids also include an openable tear strip or flap allowing limited access to the contents of the container while still coveting most of the open end of the container. Thus, a user is able to drink from the cup while the spillage-prevention and insulation qualities afforded by the lid are still largely maintained. These prior art lids are attached to the rim of the cup by simply pressing the edge of the cup downwardly onto the cup causing the peripheral sealing skirt to frictionally receive the rim of the cup. Many such lids also include a radially inwardly directed ridge which is designed to have controlled resilient expansion capability to allow the ridge to "snap-over" the cup rim to secure the lid to the cup. However, such lids suffer include a lid to prevent spilling the contents of the cup. Also, the handle extends outwardly from the cup creating an awkward projection which may be easily struck causing the contents of the cup to spill. Moreover, the handle does not permit the user to grasp both sides of the cup thereby preventing the user from firmly and steadily supporting the cup and its contents.

U.S. Pat. Nos. 4,376,493 and 4,465,205 both disclose container closures having an annular flange or wall which is rotatable downwardly to engage the rim of the container. The flange is designed to wrap around and forcibly engage the container rim thereby securely retaining the lid on the container. However, these closures are not used to sealingly engage a drinking cup and, therefore, do not experience the problems associated with inadequate lid to cup sealing and insufficient thermal protection for a user's fingers. Other similar container closures are disclosed in U.S. Pat. Nos. 3,589,551 and 3,688,942.

Consequently, there is a need for a lid for a drinking cup which can be securely attached to the cup to provide an effective seal between the lid and the cup rim while also protecting the user's hand from the thermal effects of the contents of the cup as the cup is held and manipulated.

SUMMARY OF THE INVENTION

It is an object of the present invention to provide an improved drinking cup lid which more effectively prevents spillage of the contents from the cup.

Another object of the present invention is to provide an improved drinking cup lid which allows the user to more comfortably handle a cup containing hot or cold substances. from the disadvantage that the lid may not always be adequately secured to the rim of the cup. As a result, the lid is easily partially or completely dislodged from the cup by the inadvertent action of the user thereby disrupting the lid to rim seal and causing leakage, spillage or, in the case of hot liquids, burns to the user or those in the vicinity. In addition, it has been discovered that many prior art lids include peripheral sealing skirts or grooves which do not effectively seal the lid to the cup rim resulting in slight leakage of the contents around the rim whenever the contents contact the lid to cup seal such as during transport. The importance of the sealing function of the lid is emphasized with lids having an openable flap formed in the lid within the peripheral skirt allowing the user to drink with the lid in place on the cup. While the user is drinking from the cup, the contents remains in contact with the lid to cup seal adjacent the openable flap requiring the lid to securely contact the cup rim to prevent leakage. Such openable flaps often extend through the peripheral skirt area of the lid such that the "hoop" strength of the peripheral skirt is severely reduced when the flap is removed. Since "hoop" strength contributes to the lid's sealability, opening of the flap can lead to loss in the integrity of the lid/cup seal.

Drinking cups are often used to hold liquids which are either extremely hot or extremely cold making it difficult for the user to comfortably hold the cup. As a result, the user must set the cup down between drinks or frequently switch the cup back and forth from one hand to the other. U.S. Pat. No. 4,351,447 issued to Graff discloses a container closure with two diametrically opposed radially extending pull tabs that are used in locking the closure to the container. However, the tabs are not used primarily as handles nor to protect a person's fingers from the thermal effects of the contents of the container. Also, U.S. Pat. No. 4,049,187 issued to Florian discloses a drinking cup having a tabs which rotate about hinges to form a handle for insulating the hand of the set from the temperature of the contents. However, the drinking cup does not A further object of the present invention is to provide an improved lid which can be easily and securely attached to the rim of the drinking cup to provide improved lid retention.

Yet another object of the present invention is to provide an improved drinking cup lid which insulates the user's fingers from the thermal effects of the contents of the cup.

Still another object of the present invention is to provide an improved drinking cup lid which includes a gripping portion for allowing the user to move effectively and easily handle the cup during use without requiring the cup to be touched directly.

Yet another object of the present invention is to provide an improved drinking cup and lid assembly which allows the user to drink the contents of the cup with the lid securely attached while preventing any leakage the contents through the lid to cup seal.

Still another object of the subject invention is to provide a drinking cup lid having (1) a pair of tabs rotatable into a position for securing the lid to the cup for creating an effective seal and to provide a thermally insulated gripping portion and (2) a flap formed within the lid which forms a drink-through opening when opened but does not reduce the seal forming effectiveness of the tabs.

Yet another object of the subject invention is the provision of a cup lid having a pair of tabs connected to the periphery of the lid and adapted to be rotated into a position adjacent the cup side wall to (1) positively retain the lid in sealing engagement with the cup rim, (2) provide a heat insulating, easy-to-hold grippable portion and (3) employ the user's gripping force to lock positively the tabs in their retaining position to insure no possibility that the lid will become detached from the cup or lose its sealing engagement with the cup during use.

These and other objects of the present invention are achieved by providing a lid for a drinking cup having sidewalls which terminate at a rim to form an opening wherein the lid includes a cover portion covering the cup opening and at least one tab extending from the cover portion and movable into a retaining position to attach the lid to the rim of the cap. The tabs include a retaining groove adapted to receive the rim of the cup and a latching lip adapted to sealingly engage the rim of the cup when the tabs are moved to the retaining position. The tabs also include a gripping portion positioned adjacent the cup sidewalls when the tabs are in the retaining position adapted for gripping by a user's fingers. The gripping portion is maintained a spaced radial distance from the sidewalls of the cup when the tab is in the retaining position by a hinge formed on the tab adjacent the retaining groove and a rib formed by a stiffening groove extending along a longitudinal axis of the tab. The hinge also provides a pivot axis along the tab about which the tab rotates into the retaining position. The rib also provides support to the tab to ensure the tab rotates about the pivot axis. The lid may be provided with two tabs positioned diametrically opposite one another on the cover portion. The cover portion may include an openable flap positioned between the two tabs for dispensing the contents of the cup wherein the flap is formed internally of the peripheral area of the lid to preserve the hoop strength of the peripheral portion of the lid to preserve the retention effectiveness of the lid tabs.

BEST MODE FOR CARRYING OUT THE INVENTION

The novel drinking cup lid of the present invention indicated generally at 10 (FIG. 1) is designed to be detachably secured to the open end of a beverage container indicated generally at 12 (FIG. 2), such as a styrofoam or paper drinking cup. Lid 10 may be fabricated from virtually any thermoplastic material which may be formed into the desired configuration by vacuum molding. Suitable thermoplastic materials include high density polyethylene, polyvinyl chloride, polypropylene, polystyrene and the like. These materials all provide the advantages of low cost, high strength, ease of fabrication, and desirable mechanical properties, such as resilience, required for the proper functioning of the lid.

Figure 1:
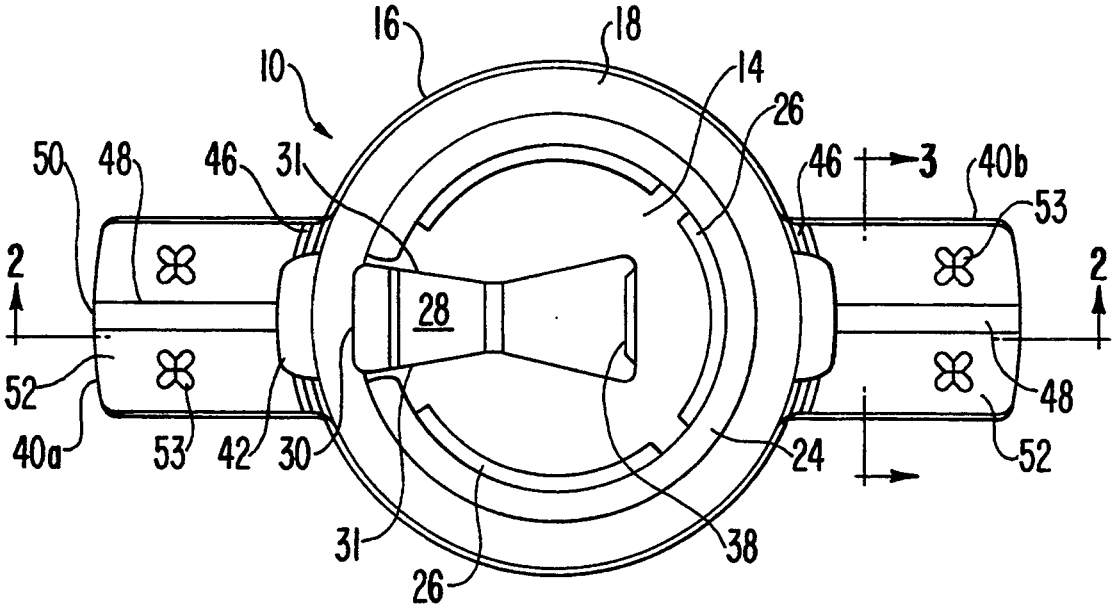
FIG. 1 is a top plan view of the drinking cup lid of the present invention.
Figure 2:
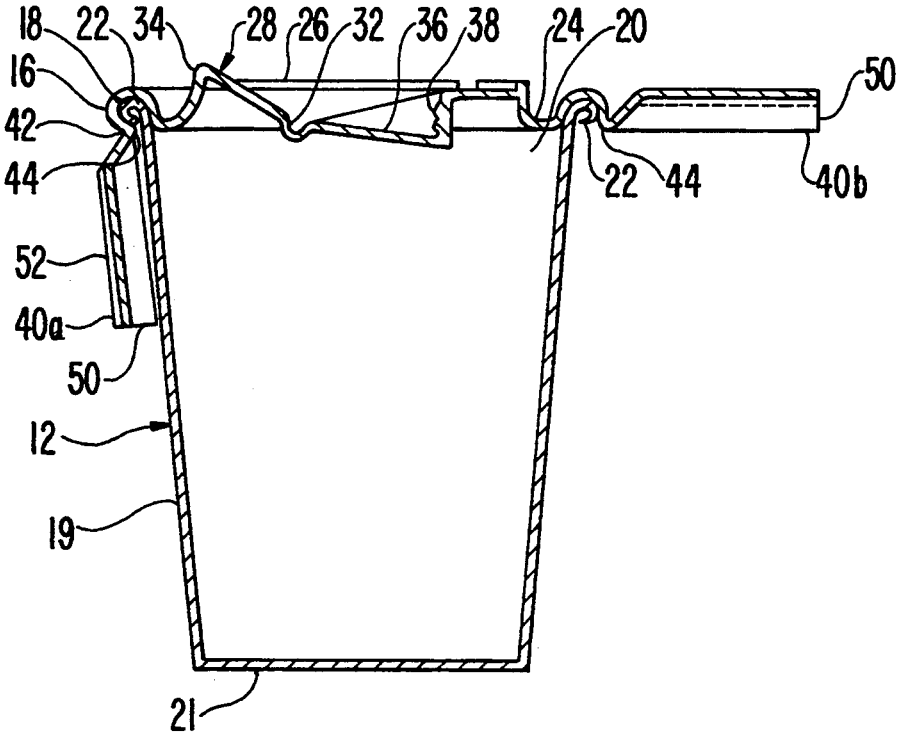
FIG. 2 is a cross-sectional view of the cup lid of FIG. 1 taken along plane 2—2 showing the lid attached to a cup and one tab moved into the retaining position.

Referring to FIGS. 1 and 2, lid 10 includes a generally flat cover portion 14 which is circumscribed by a peripheral skirt 16. The skirt 16 has a generally inverted U-shaped cross-section which defines an annular receiving channel 18 around the entire periphery of lid 10. The diameter of lid 10 and dimensions of receiving channel 18 are selected to correspond to the dimensions of a rim 22 of a particular drinking cup, such as cup 12, and lid 10 is thus able to mate with rim 22 and seal the open end of cup 12. An annular inwardly directed ridge or indentation (not shown) may also be provided in the outer wall of skirt 16 to help form the seal between lid 10 and rim 22 by expanding radially outwardly.

Lid 10 will normally include one or more annular channels 24 and a plurality of annular ridges 26 which act to reinforce the lid and make it more rigid. The number of such reinforcement channels and ridges is not critical.

Drinking cup 12 is formed by generally frustoconically-shaped sidewalls 19 closed at one end by a bottom wall 21. Sidewall 19 terminates at a rim 22 which forms a circular opening 20. Rim 22 is conventionally formed on paper cups by rolling the edge of sidewall 19 outwardly to form a seating surface adapted to be received within channel 18 of the lid.

Lid 10 may also include an openable flap 28 which permits a user to drink the contents of the cup while the lid remains attached to rim 22. Flap 28 is defined by lines of weakness which include a circumferential frangible line of weakness 30 located adjacent but inside channel 18 and a pair of frangible lines of weakness 31 extending radially inwardly from the ends of line of weakness 30 to a hinge 32. Flap 28 also includes a finger ridge 34 extending outwardly from opening 20 to allow a user to grip flap 28 for breaking lines of weakness 30 and 31 to allow flap 28 to be rotated about hinge 32 to create a drink-through opening within cover portion 14. A recess 36 formed in cover portion 14 adjacent flap 28 is dimensioned to receive flap 28. At least one transverse overhang 38 may be formed along one surface of recess 36 to engage, and hold, flap 28 in recess 36. A user may open flap 28 by pulling on finger ridge 34 toward recess 36 which results in a tearing of flap 28 along lines of weakness 30 and 31. The flap can then be folded about hinge 32 and secured in recess 36. Because the drink-through opening defined by flap 28 is located entirely within cover portion 14, the hoop strength integrity of receiving channel 18 is preserved thereby preserving the lid/cup seal and promoting the effectiveness of the lid tabs as will be explained more thoroughly below.

Lid 10 also includes a pair of tabs 40*a*, 40*b* extending radially outwardly from cover portion 14. Preferably, tabs 40*a* and 40*b* are rectangular in shape and integrally formed with cover portion 14. Tabs 40*a* and 40*b* are identical in construction and are both movable between an extended position, as represented by tab 40*b* in FIG. 2 and a retaining position, as represented by tab 40*a* in FIG. 2.

Tabs 40*a*, 40*b* are each provided with a retaining groove 42 positioned radially outward from, and adjacent to, receiving channel 18. Retaining groove 42 extends adjacent to rim 22 along a central circumferential portion of the width of tabs 40*a*, 40*b* (FIG. 1) and forms a latching lip 44 when the tab is rotated into its retaining position (FIG. 2). Retaining groove 42 and latching lip 44 are formed along the curvature of rim 22 to cause latching lip 44 to abut rim 22 when lid 10 is pressed onto cup 12. A hinge 46 is formed on each side of retaining groove 42 and extends along tabs 40*a*, 40*b* with a curvature corresponding to the curvature of rim 22. Hinge 46, which may be formed by one or more reduced thickness score lines, creates a pivot axis about which tabs 40*a*, 40*b* can be rotated between the extended position and the retaining position.

Tabs 40*a*, 40*b* also include a stiffening groove 48 formed along its central longitudinal axis and extending from retaining groove 42 to an outer end of tab 40*a*, 40*b* opposite groove 42. Stiffening groove 48, which is preferably semi-cylindrical in shape, forms a rib 50 facing sidewall 19 of cup 12. Tabs 40*a*, 40*b* also include a gripping portion 52 having a generally flat surface facing away from sidewall 19 and interrupted by stiffening groove 48. When tabs 40*a*, 40*b* are in the retaining position adjacent sidewall 19, rib 50 contacts sidewall 19 thereby maintaining gripping portion 52 a spaced distance from sidewall 19. In this manner, a user can hold cup 12 by grasping each gripping portion 52 with the fingers without feeling the hot or cold temperature of the contents of the cup allowing the user to comfortably and continuously hold the cup. Preferably, lid 10 is provided with two tabs positioned diametrically opposite one another. In this manner, with the tabs 40*a*, 40*b* in the retaining position, the gripping portion 52 of each tab 40*a*, 40*b* is positioned on the outer surface area of the cup normally gripped by a user during holding and drinking. However, it should be noted that similar tabs could be provided at other locations around the perimeter of skirt 16 to provide insulated gripping portions around other areas of the cup sidewalls. Flap 28 is positioned adjacent tab 40*a* along the diametral line extending between tabs 40*a* and 40*b*. This position of flap 28 causes the drink-through opening to be ideally positioned when the cup is gripped by the user. For the reasons described below, location of flap 28 adjacent one of the tabs provides the further advantage that the cup/lid seal is improved adjacent the drink-through opening where it is needed most.

Gripping portion 52 may be provided with decorative patterns 53 of various shapes and sizes. These patterns 53 may be formed by raised or embossed areas to improve the gripping effect of the user's fingers.

As tabs 40*a*, 40*b* are moved into the retaining position, latching lip 44 is forced around rim 22 forcing rim 22 fully into the portion of receiving channel 18 adjacent retaining groove 42. Once tabs 40*a*, 40*b* are in the retaining position as shown by tab 40*a* in FIG. 2, lip 44 acts as a latch to securely hold lid 10 on rim 22 of cup 12. By forcing rim 22 into receiving channel 18, latching lip 44 also provides an improved seal between lid 10 and rim 22. The sealing function of retaining groove 42 and latching lip 44 is especially valuable, since liquid might otherwise flow over the juncture of lid 10 and rim 22 immediately outward of the opening created by the opening of flap 28 while the user drinks from the cup. Hinge 46 is formed along each of the tabs 40*a*, 40*b* to position the pivot axis relative to rim 22 to ensure latching lip 44 properly engages rim 22 while assisting in maintaining gripping portion 52 a spaced radial distance from sidewall 19.

Figure 3:
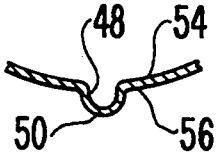
FIG. 3 is a sectional view of the tab portion of the lid of the present invention taken along plane 3—3 of FIG. 1 showing the biasing feature for biasing the tab in the extended position.
Figure 4:
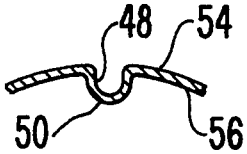
FIG. 4 is a sectional view of the tab portion of the lid of the present invention taken along plane 3—3 of FIG. 1 with the tab moved to the retaining position to show the biasing feature for biasing the tab in the retaining position.

Tabs 40*a* and 40*b* are maintained in the extended position and, more importantly, in the retaining position by a biasing feature shown in FIGS. 1, 3 and 4. As noted above, lid 10 may be formed of a variety of synthetic resinous materials all of which possess a degree of resilient flexibility. This characteristic, in combination with the lid design, is employed in the present design to impart a desired biasing force to the lid tabs. As previously mentioned, hinge 46 is formed by score lines which are parallel to the curvature of receiving channel 18 and rim 22. In addition, as shown in FIG. 3, tabs 40*a*, 40*b* are molded to have a slight curvature so that, in the extended position, an outer surface 54 is concave while an inner surface 56 is convex. This concavo-convex design biases tabs 40*a*, 40*b* in the extended position. As the tabs are pushed into the retaining position, the concavo-convex tab design combined with the curvature of the hinge 46 forces tabs 40*a*, 40*b* to flex or buckle causing outer surface 54 into a convex shape and inner surface 56 into a concave shape as shown in FIG. 4. As a result, gripping portion 52 conforms generally to the curvature of sidewall 19. Simultaneously, tabs 40*a*, 40*b* are biased inwardly toward sidewall 19. This biasing feature also forces latching lip 44 against rim 22, thereby effectively securing lid 10 on cup 12 while maintaining an effective seal between skirt 16 and rim 22.

Referring now to FIGS. 1 and 2, the use of lid 10 will be described in detail. Lid 10 is positioned over opening 20 of drinking cup 12 so that rim 22 is positioned below receiving channel 18. The lid is then pressed on to cup 12 so that receiving channel 18 fully receives rim 22. Tabs 40*a* and 40*b* are then rotated from the extended position as represented by tab 40*b* in FIG. 2 to the retaining position as represented by tab 40*a* in FIG. 2. The user may then lift flap 28 using finger ridge 34 allowing flap 28 to be rotated about hinge 32 into recess 36. Overhang 38 will mate with flap 28 to secure flap 28 in recess 36. The user may then hold cup 12 by grasping gripping portions 52 of tabs 40*a*, 40*b*. When the user desires to consume liquid from the cup, flap 28 may be rotated into an open position. Because the periphery of lid 10 remains intact, the lid-to-cup seal remains fully effective. Moreover, movement of tab 40*a* into its retaining position immediately adjacent the drink-through opening insures that the lid-to-cup seal in this area is especially effective due to the function of latching lip 44 or tab 40*a*. The user's fingers are insulated from the thermal effects of the contents of the cup by gripping portion 52 which is maintained a spaced distance from sidewall 19 by rib 50 and hinge 46. Therefore, the user can comfortably hold cup 12 without experiencing the discomfort associated with extreme hot or cold temperatures of the sidewall 19. During this time, latching lip 44 effectively secures and seals lid 10 on rim 22. If access to the interior of the cup is desired, tabs 40*a*, 40*b* can be moved back into the extended position disengaging lip 44 from around rim 22 allowing lid 10 to be removed from cup 12.

Figure 5:
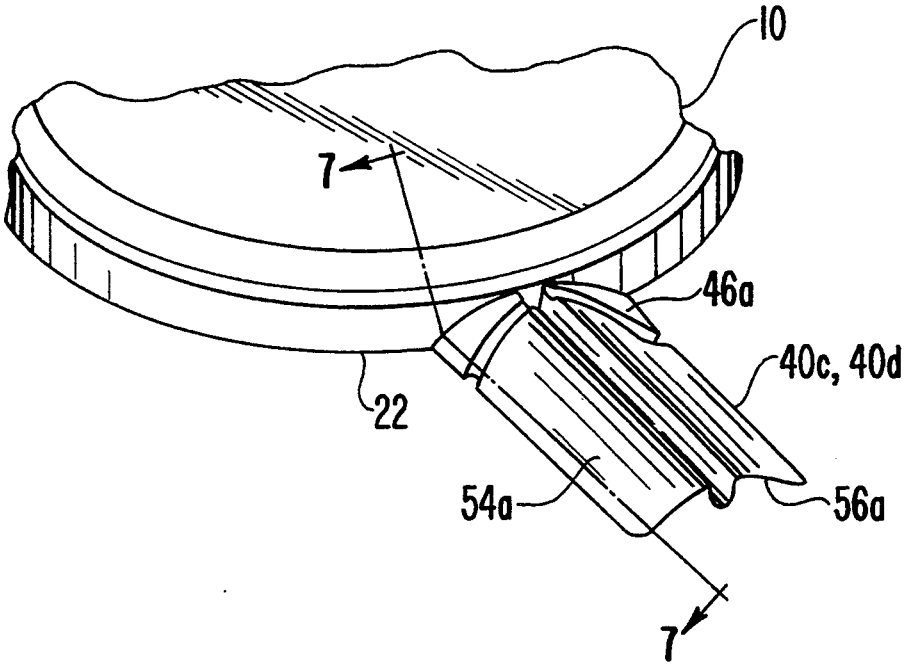
FIG. 5 is a fragmentary elevation of a second embodiment of the lid of the present invention showing one tab in the extended position.
Figure 6:
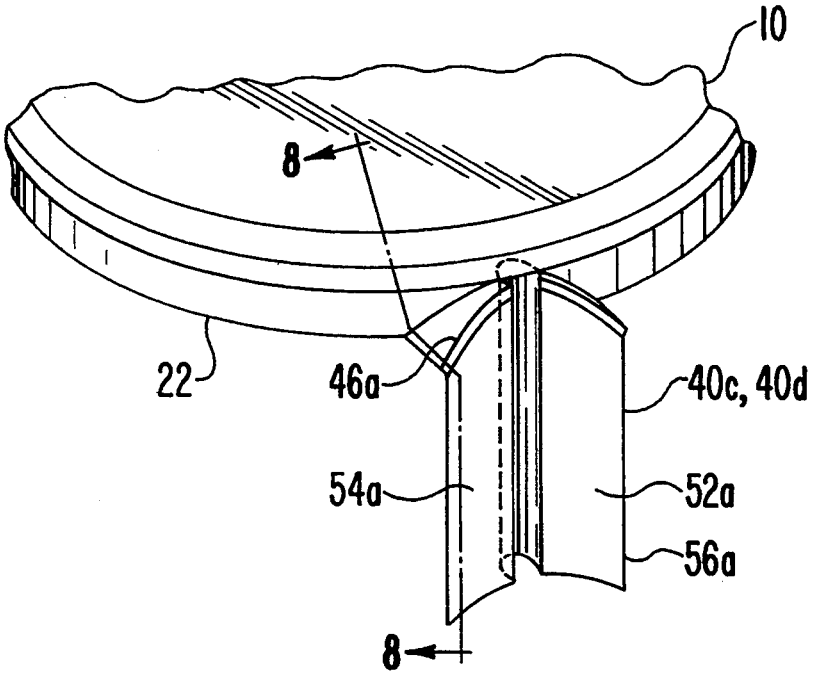
FIG. 6 is a fragmentary elevation of a second embodiment of the lid of FIG. 5 showing one tab in the retaining position.
Figure 7:
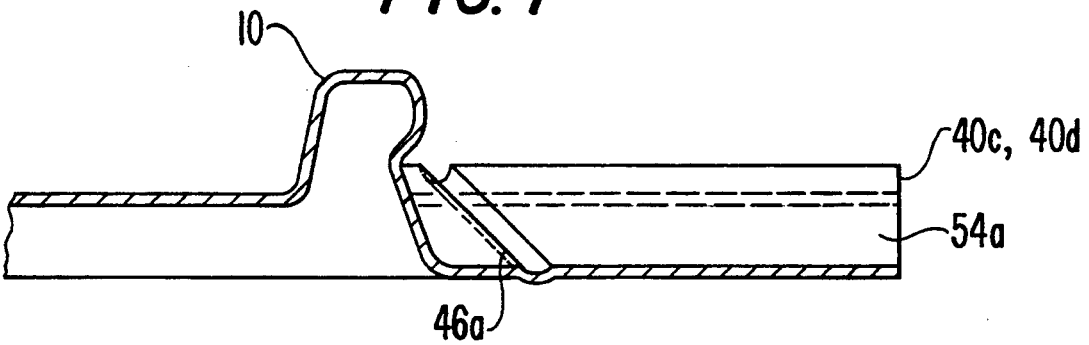
FIG. 7 is a partial cross-sectional view of the lid and tab of FIG. 5 taken along plane 7—7.
Figure 8:
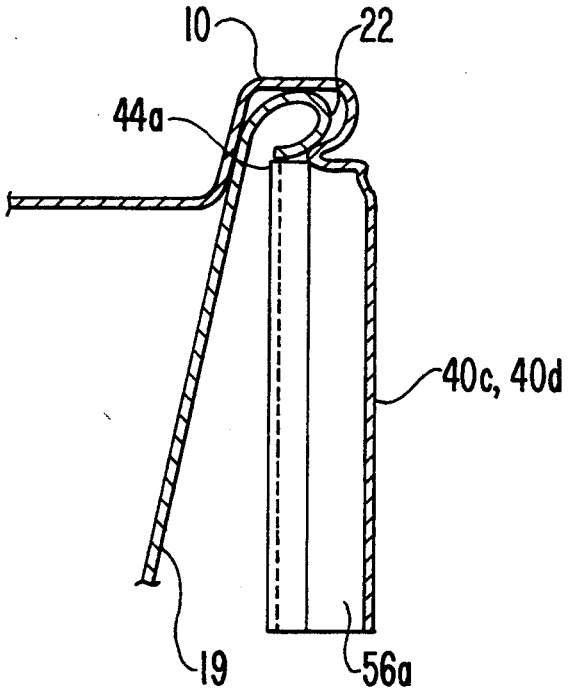
FIG. 8 is a partial cross-sectional view of the lid and tab of FIG. 6 taken along plane 8—8.
Figure 9:
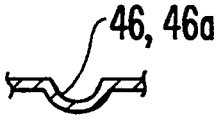
FIGS. 9 and 10 are partial sectional views of the tabs of the present invention showing two forms of the tab hinge.
Figure 10:
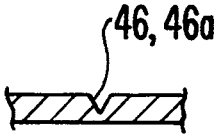

Referring to FIGS. 5–8, another embodiment of the biasing feature of the present invention is shown wherein tabs 40*c*, 40*d* are formed with a concavo-convex design opposite of the embodiment disclosed in FIGS. 1–4. Again, lid 10 may be formed of a resilient material which, in combination with this lid design, imparts a desired biasing force to the lid tabs. However, as best shown in FIGS. 5 and 6, in this embodiment a hinge 46*a* forms an arc having a curvature opposite to the curvature of the rim 22. In addition, tabs 40*c*, 40*d* are molded to have a slight curvature so that, in the extended position, outer surface 54*a* is convex while inner surface 56*a* is concave. As shown in FIGS. 5 and 7, this concavo-convex design biases tabs 40*c*, 40*d* in the extended position. As the tabs are pushed into the retaining position, the concavo-convex tab design combined with the curvature of hinge 46*a* forces tabs 40*c*, 40*d* to flex or buckle causing outer surface 54*a* into a concave shape and inner surface 56*a* into a convex shape as shown in FIGS. 6 and 8. As a result, gripping portion 52*a* curves outwardly away from sidewall 19 generally conforming to the curvature of a user's fingers and thumb. Simultaneously, tabs 40*c*, 40*d* are biased inwardly toward sidewall 19 while latching lip 44*a* is forced to engage the lower surface of rim 22. As shown in FIG. 9, hinges 46 and 46*a* may be formed by molding a groove in tabs 40*a*, 40*b* and 40*c*, 40*d*, respectively. Alternatively, as shown in FIG. 10, hinges 46 and 46*a* may be formed by scoring one surface of the tabs.

INDUSTRIAL APPLICABILITY

The present invention provides a drinking cup lid which insulates the user's fingers from the thermal effects of the contents of the cup while securely attaching the lid to the rim of the cup. The lid can be used on a variety of containers and cups for holding hot or cold liquids or substances.

We claim:

1. A closure for a drinking cup having sidewalls which terminate at a rim to form an opening, comprising:

a cover portion for covering the opening of the cup, said cover portion having an outer circumferential extent;

at least one tab extending from said cover portion around less than said outer circumferential extent, said at least one tab including a proximal end attached to said cover portion, a distal end free of circumferential support and a retaining means for engaging the rim of the cup, said at least one tab movable into a retaining position adjacent the cup causing said retaining means to engage the rim of the cup to retain said closure on the cup, wherein said at least one tab includes a gripping portion extending adjacent to the sidewalls of the cup when said at least one tab is in said retaining position, said gripping portion including a gripping surface facing outwardly from the sidewalls of the cup when said at least one tab is in said retaining position for gripping by a user's fingers while grasping the cup.

2. The cup closure as defined in claim 1, further including a separating means formed on said at least one tab for maintaining said gripping portion a spaced radial distance from the sidewalls of the cup when said at least one tab is in said retaining position.

3. The cup closure as defined in claim 2, wherein said at least one tab includes a hinge formed on said at least one tab adjacent said retaining means, said hinge providing a pivot axis along said at least one tab for moving said at least one tab into said retaining position.

4. The cup closure as defined in claim 2, wherein said hinge is formed to cause said tab to be biased against the cup side wall when said at least one tab is rotated into said retaining position.

5. The cup closure as defined in claim 3, wherein said separating means further includes a rib formed on said at least one tab, said rib positioned in abutting relationship with the sidewalls of the cup when said at least one tab is positioned in said retaining position.

6. The cup closure as defined in claim 5, wherein said rib is formed by a stiffening groove formed in said at least one tab and extending from a first end of said at least one tab adjacent said retaining means to a second end of said at least one tab.

7. The cup closure as defined in claim 6, wherein said pivot axis extends through said retaining means and said stiffening groove extends perpendicularly from said retaining means along a central longitudinal axis of said at least one tab.

8. The cup closure as defined in claim 6, wherein said stiffening groove is substantially semi-cylindrically shaped.

9. The cup closure as defined in claim 1, wherein said at least one tab includes two tabs positioned diametrically opposite one another on said cover portion.

10. The cup closure as defined in claim 9, wherein said cover portion includes an openable flap movable to an open position for dispensing contents from the cup.

11. The cup closure as defined in claim 10, wherein said openable flap is formed in said cover portion adjacent one of said two tabs and positioned between said two tabs along a diametrical axis formed between said two tabs.

12. The cup closure as defined in claim 1, wherein said cover portion is circular-shaped and includes an annular receiving channel for receiving the rim of the cup.

13. The cup closure as defined in claim 1, wherein said retaining means includes a retaining groove and latching lip formed on said at least one tab, said retaining groove adapted to receive the rim of the cup, said latching lip forming a portion of said retaining groove and adapted to engage the rim of the cup when said at least one tab is in said retaining position.

14. The cup closure as defined in claim 1, wherein said gripping portion is rectangularly shaped and positioned substantially parallel to sidewalls of the cup when said at least one tab is in said retaining position.

15. The cup closure as defined in claim 1, wherein said at least one tab is movable between an extended position in which said at least one tab extends radially outward from said cover portion and said retaining position, said at least one tab including a first surface having a concave shape and a second surface opposite said first surface having a convex shape when said at least one tab is in said extended position, said first surface having a convex shape and said second surface having a concave shape when said at least one tab is in said retaining position.

16. The cup closure as defined in claim 15, wherein said cup closure is formed of resiliently flexible material and includes an annular receiving channel for receiving the rim of the cup and said retaining means includes a retaining groove and latching lip formed on said at least one tab, said latching lip forming a portion of said retaining groove and adapted to engage the rim of the cup when said at least one tab is rotated into said retaining position to force the cup rim fully into said annular receiving channel, and further wherein said at least one tab includes a curved hinge formed adjacent said annular receiving channel to cause said at least one tab to be flexed during rotation to its retaining position to create a biasing force tending to hold said tab against the cup side wall.

17. The drinking cup as defined in claim 16, wherein said curved hinge forms an arc having a curvature substantially opposed to a curvature of the rim.

18. A drinking cup, comprising:

a cup portion including sidewalls positioned to form a cavity for receiving a substance and an opening formed at a first end of said cup portion by an upper rim of said sidewalls;

a cover portion for covering said opening said cup portion, said cover portion having an outer circumferential extent;

at least one tab extending from said cover portion around less than said outer circumferential extent, said at least one tab including a proximal end attached to said cover portion, a distal end free of circumferential support and a retaining means for engaging said cup portion, said at least one tab movable into a retaining position adjacent said sidewalls causing said retaining means to engage said upper rim to retain said cover portion on said cup portion, wherein said at least one tab includes a gripping portion extending adjacent to said sidewalls of said cup portion when said at least one tab is in said retaining position, said gripping portion including a gripping surface facing outwardly from said sidewalls of the cup when said at least one tab is in said retaining position for gripping by a user's fingers while grasping the cup.

19. The drinking cup as defined in claim 18, wherein said gripping portion is positioned adjacent said sidewalls along said at least one tab a spaced distance from said retaining means when said at least one tab is in said retaining position.

20. The drinking cup as defined in claim 19, further including a separating means formed on said at least one tab for maintaining said gripping portion a spaced radial distance from said sidewalls when said at least one tab is in said retaining position.

21. The drinking cup as defined in claim 20, wherein said separating means includes a hinge formed on said at least one tab adjacent said retaining means, said hinge providing a pivot axis along said at least one tab for moving said at least one tab into said retaining position.

22. A closure for a drinking cup having sidewalls which terminate at a rim to form an opening, comprising:

a cover portion for covering the opening of the cup;

at least one tab extending from said cover portion and including a retaining means for engaging the rim of the cup, said at least one tab movable into a retaining position adjacent the cup causing said retaining means to engage the rim of the cup to retain said closure on the cup, said at least one tab including a gripping portion extending adjacent to the sidewalls of the cup when said at least one tab is in said retaining position for gripping by a user's fingers wherein said at least one tab includes two tabs positioned diametrically opposite one another on said cover portion.

23. A closure for a drinking cup having sidewalls which terminate at a rim to form an opening, comprising:

a cover portion for covering the opening of the cup;

at least one tab extending from said cover portion and including a retaining means for engaging the rim of the cup, said at least one tab movable into a retaining position adjacent the cup causing said retaining means to engage the rim of the cup to retain said closure on the cup, said at least one tab including a gripping portion extending adjacent to the sidewalls of the cup when said at least one tab is in said retaining position for gripping by a user's fingers, said at least one tab further including a hinge formed on said at least one tab adjacent said retaining means, said hinge providing a pivot axis along said at least one tab for moving said at least one tab into said retaining position; and a separating means formed on said at least one tab for maintaining said gripping portion a spaced radial distance from the sidewalls of the cup when said at least one tab is in said retaining position, wherein said separating means further includes a rib formed on said at least one tab, said rib positioned in abutting relationship with the sidewalls of the cup when said at least one tab is positioned in said retaining position.

* * * * *